US006382184B2

(12) United States Patent
Nakamura et al.

(10) Patent No.: US 6,382,184 B2
(45) Date of Patent: May 7, 2002

(54) DEVICE FOR CONTROLLING FUEL PRESSURE OF ENGINE AND METHOD THEREOF

(75) Inventors: Yoshitatsu Nakamura; Masaki Nakamura; Toru Kitayama, all of Atsugi (JP)

(73) Assignee: Unisia Jecs Corporation, Kanagawa-ken (JP)

( * ) Notice: Subject to any disclaimer, the term of this patent is extended or adjusted under 35 U.S.C. 154(b) by 0 days.

(21) Appl. No.: 09/725,681

(22) Filed: Nov. 30, 2000

(30) Foreign Application Priority Data

Nov. 30, 1999 (JP) ..... 11-339319

(51) Int. Cl.[7] ..... F02M 37/20
(52) U.S. Cl. ..... 123/464; 123/497
(58) Field of Search ..... 123/457–465, 123/497–499

(56) References Cited

U.S. PATENT DOCUMENTS 5,605,133 A * 2/1997 Tuckey ..... 123/464 X
5,694,902 A * 12/1997 Miwa et al. ..... 123/497 X
6,067,963 A * 5/2000 Oi et al. ..... 123/497 X

FOREIGN PATENT DOCUMENTS

JP 07-293397 11/1995
JP 09-042109 2/1997

* cited by examiner

*Primary Examiner*—Tony M. Argenbright
(74) *Attorney, Agent, or Firm*—Sughrue Mion, PLLC

(57) ABSTRACT

In a fuel pressure control system of a non-return system which feedback controls the fuel pressure supplied to a fuel injection valve to meet the fuel supply amount, a fuel pressure in a fuel supply passage is feedback controlled to become a pressure corresponding to the engine environmental temperature condition of during the engine operation stop.

10 Claims, 6 Drawing Sheets

DEVICE FOR CONTROLLING FUEL PRESSURE OF ENGINE AND METHOD THEREOF

BACKGROUND OF THE INVENTION

1. Field of the Invention

The present invention relates to technology for controlling the fuel pressure supplied to fuel injection valves of an engine. More particularly, the invention relates to technology for properly controlling the fuel pressure during an engine stop according to the environment.

2. Related Art of the Invention

In order to prevent a rise in the temperature of fuel caused by excess fuel to be returned into a fuel tank from a pressure regulator, there has been proposed a system as fuel supply device of an engine constituted such that no pressure regulator is provided but, instead, a sensor is provided to detect the fuel pressure in a fuel supply passage, a discharge amount of a fuel pump is controlled according to the fuel pressure detected by the sensor to obtain a required fuel pressure that meets an engine operation condition, so that the discharge amount of the fuel pump is brought into agreement with a required fuel amount to suppress the production of excess fuel (Japanese Unexamined Patent Publication No. 7-293397).

According to this device for supplying fuel, when the engine operation is stopped, as a result that the operation of the fuel pump is stopped, the fuel pressure remaining in the fuel supply passage downstream of a check valve for preventing the return of fuel becomes a value feedback controlled by to a target fuel pressure during the operation (usually, idling) just before the stop of engine operation.

When the engine operation is stopped after the engine has been warmed up and then, the engine is restarted after about one to two hours have passed, however, demands on the fuel pressure to obtain favorable startability of the engine conflict with each other depending on the environmental conditions of the engine.

That is, under a heat-resisting wherein an engine environmental temperature (atmospheric air temperature, water temperature when the engine operation is stopped, and ultimately, fuel temperature) is high, the fuel in the fuel supply passage is vaporized to generate vapor and the required fuel amount is not injected at the restart of the engine, resulting in that an air-fuel ratio becomes lean deteriorating the startability. In order to prevent vaporization of the fuel, therefore, the fuel pressure is required to be raised.

Under an ordinary engine environmental temperature condition (atmospheric air temperature of up to about 25° C.), on the other hand, when the fuel in a large amount is leaked out through a nozzle hole of the fuel injection valve during the engine is not in operation, the air-fuel ratio becomes too rich at the restart of the engine to deteriorate the startability. In order to prevent the leakage of fuel, therefore, the fuel pressure is required to be lowered.

So far, the target fuel pressure during the idling operation that is usually carried out just before the engine operation stop has been set to an intermediate value of the above described respective required fuel pressures, failing to satisfy neither requirements to a sufficient degree. Besides, since the fuel pressure has been set to be higher than a fuel pressure required during the idling operation, a difference in the fuel pressure occurs relative to the operation region near the idling operation. Therefore, the operation performance is lost due to a delay in the fuel pressure feedback control, and the fuel economy becomes poor due to an increase in the force for driving the fuel pump.

There has further been proposed a system equipped with a pressure regulator to control the fuel pressure to be constant during the engine operation, wherein the fuel temperature is detected at the time when the operation is stopped, and the fuel pressure is lowered by opening the relief valve when the fuel temperature is so low as will not generate vapor (Japanese Unexamined Patent Publication No. 9-42109). With this system, however, it is difficult to accurately adjust the fuel pressure and, besides, the adjustment is accomplished only in a direction to lower the fuel pressure (to prevent the leakage of fuel).

SUMMARY OF THE INVENTION

The present invention was accomplished by giving attention to the above problems in the conventional technique, and has an object of accomplishing a favorable restartability by properly adjusting the fuel pressure at the time when the engine operation is stopped.

Another object is to easily adjust the fuel pressure by a control operation similar to that of during the engine is in operation.

A further object is to properly adjust the fuel pressure over a wider range.

A still further object is to more properly set the fuel pressure during the idling operation accompanying the adjustment of the fuel pressure at the engine operation stop.

In order to accomplish the above-mentioned objects, the present invention is basically constituted as described below.

During the engine is in operation, the drive of a fuel pump is feedback controlled so as to accomplish a target fuel pressure while detecting the fuel pressure supplied from a fuel pump to a fuel injection valve through a fuel supply passage equipped with a check valve.

It is detected that the engine operation is stopped, and the engine environmental temperature is detected during the operation is stopped.

Further, during the engine operation is stopped, by feedback controlling the drive of the fuel pump, the fuel pressure in the fuel supply passage is adjusted to reach a fuel pressure corresponding to the engine environmental temperature condition during the engine operation stop.

With this constitution, when the engine is in operation, the fuel pressure is feedback controlled to become a target fuel pressure to be set according to the engine operation condition while detecting the fuel pressure. When the engine operation is stopped, the engine environmental temperature condition during the engine operation stop is detected, and the fuel pressure is feedback controlled so as to reach a value corresponding to the environmental temperature condition.

In this way, after the engine operation is stopped, the fuel pressure in the fuel supply passage downstream of the check valve may be adjusted to be higher to suppress the vaporization of fuel under a heat-resisting condition that the environmental temperature is high, while the fuel pressure may be adjusted to be lower to suppress the leakage of fuel from the fuel injection valve under an ordinary condition that the engine environmental temperature is low. Thereby accomplishing favorable startability in either condition.

Further, when the engine is not in operation, the fuel pressure in the fuel supply passage may be adjusted by the feedback control to become a target fuel pressure during the idling operation, under a condition that the engine environmental temperature is equal to or lower than a set temperature, while, under the condition that the engine environmental temperature exceeds the set temperature, the fuel pressure in the fuel supply passage may be adjusted by the feedback control to become a heat-resistant target fuel pressure set to be higher than the fuel pressure during the engine is in operation.

In this way, when the engine environmental temperature during the engine operation stop is equal to or lower than the set temperature, the fuel pressure can be adjusted to the target fuel pressure during the idling operation to suppress the leakage of fuel from the fuel injection valve. When the engine environmental temperature during the engine operation stop exceeds the set temperature, on the other hand, the fuel pressure can be adjusted to the heat-resistant target fuel pressure set to be higher than the fuel pressure during the engine is in operation to suppress the vaporization of fuel, thereby improving the restartability. Besides, the target fuel pressure during the idling operation can be set to be lower without the need of giving consideration to the heat-resisting, thereby improving the operating performance and fuel economy.

Further, when the engine is not in operation, the fuel pressure in the fuel supply passage may be adjusted by the feedback control to become a target fuel pressure set to be lower than the fuel pressure during the engine is in operation after the fuel in the fuel supply passage is once drained by opening a relief valve connected to the fuel supply passage by-passing the check valve, under the condition that the engine environmental temperature during the engine operation stop is equal to or lower than the set temperature, while, under the condition that the engine environmental temperature during the engine operation stop is higher than the set temperature, the fuel pressure may be adjusted by the feedback control to become a heat-resisting target fuel pressure set to be higher than the fuel pressure during the engine is in operation.

Therefore, when the engine environmental temperature of during the engine operation stop is equal to or lower than the set temperature, after the fuel in the fuel supply passage is drained by opening the relief valve to lower the fuel pressure, the fuel pressure is adjusted to become the target fuel pressure set to be lower than the fuel pressure during the engine is in operation by taking into consideration a rise in the fuel pressure due to an increase in the temperature during the soaking, so that the leakage of fuel from the fuel injection valve can be more efficiently suppressed to thereby further improve the restartability. When the engine environmental temperature during the engine operation stop exceeds the set temperature, further, the fuel pressure is adjusted to become the heat-resisting target fuel pressure set to be higher than the fuel pressure during the engine is in operation, thereby suppressing the vaporization of fuel to improve the restartability.

Further, the engine environmental temperature may be detected by a detection value of an engine cooling water temperature or by a value obtained by adding a detection value of an intake air temperature or an on/off detection value of an air conditioner to the detection value of the engine cooling water temperature.

When a detection value of a water temperature sensor which is essential for controlling the engine is used, the engine environmental temperature condition can be easily detected without increasing the cost, and further, the engine environmental temperature condition can be detected more accurately if the detection value of the intake air temperature or the on/off detection value of the air conditioner is added to the detection value of the engine cooling water temperature.

Further, the engine environmental temperature condition may be detected by detecting the fuel temperature.

In this way, it possible to most accurately detect the engine environmental temperature condition for adjusting the pressure of the fuel.

The other objects and features of this invention will become understood from the following description with reference to the accompanying drawings.

DESCRIPTION OF THE PREFERRED EMBODIMENTS

Embodiments of the present invention will now be explained with reference to the drawings.

Figure 1:
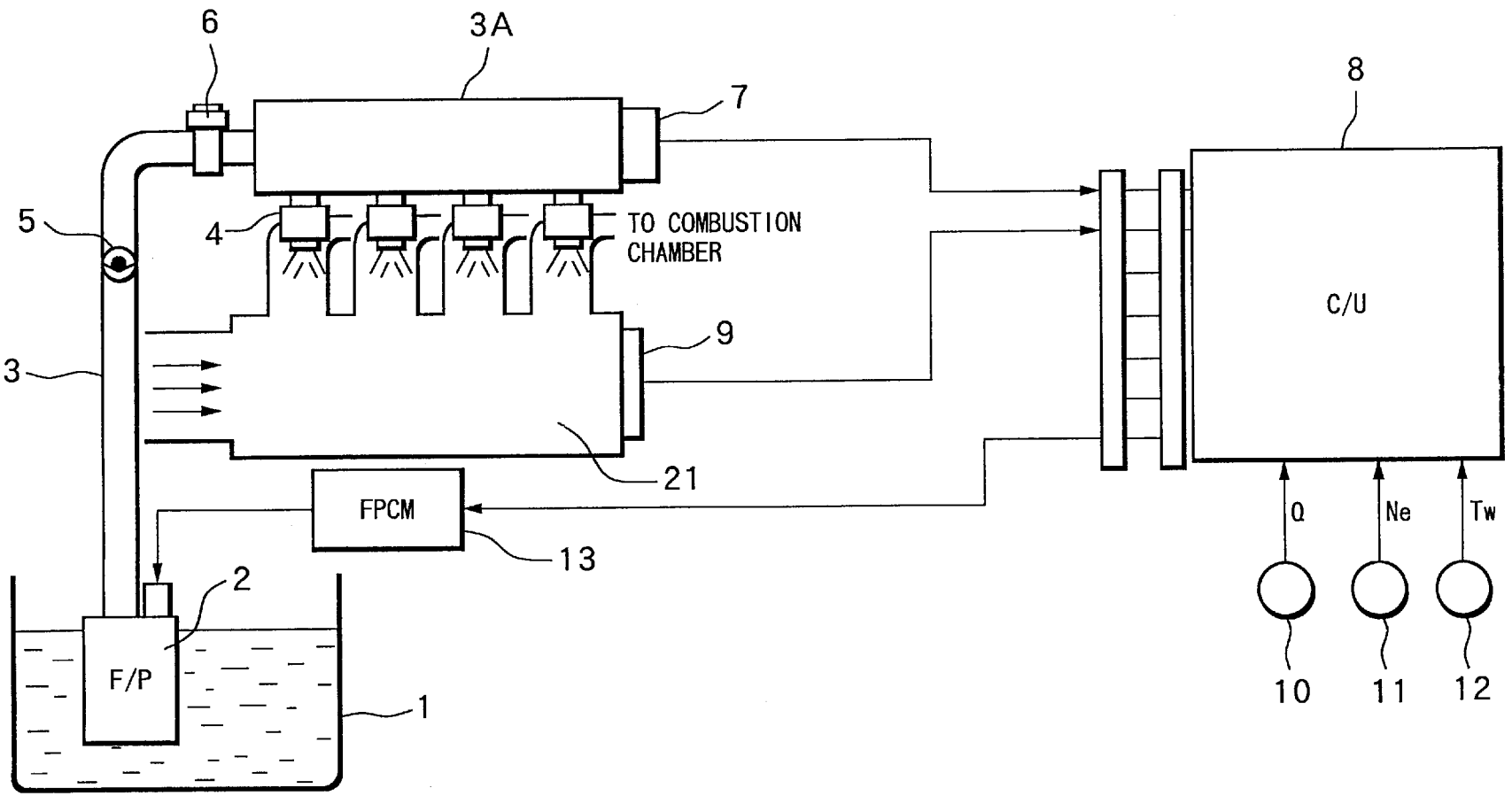
FIG. 1 is a diagram illustrating a system constitution of a first embodiment according to the present invention.

In FIG. 1 illustrating a system constitution according to a first embodiment, fuel in a fuel tank 1 is sucked by an electrically driven fuel pump 2. The fuel discharged from the fuel pump 2 is sent with pressure to a fuel injection valve 4 in each cylinder through a fuel supply passage 3.

In the fuel supply passage 3 are disposed a check valve 5 and a fuel damper 6 from the upstream side. A fuel gallery unit 3A at the downstream end is provided with a fuel pressure sensor 7 that detects the fuel pressure as a gauge pressure with respect to the atmospheric pressure.

The fuel injection valve 4 is of an electromagnetic type which opens when a current is supplied to a solenoid and closes when no current is supplied. The fuel injection valve 4 is controlled to open by a drive pulse signal of a predetermined pulse width Ti (valve-opening time) corresponding to a fuel amount required by an engine, that is sent from a control unit 8 to be described later, to inject fuel into an intake manifold 21 on the downstream side of the throttle valve of the engine (not shown in the figure).

The intake manifold 21 is provided with an intake air pressure sensor (absolute pressure sensor) 9 that detects a negative intake pressure in the intake manifold 21 during the engine is in operation and detects the atmospheric pressure during the engine operation is stopped.

The control unit 8 receives a detection signal from the fuel pressure sensor 7, as well as an intake air amount detection signal Q from an air flow meter 10, an engine rotation speed signal Ne from a crank angle sensor 11, and an engine cooling water temperature (hereinafter referred to as water temperature) Tw from a water temperature sensor 12.

The control unit 8 incorporating therein a microcomputer computes the fuel amount required by the engine, i.e., a basic fuel injection pulse width Tp (basic valve opening time) corresponding to a cylinder intake air amount, based on the intake air amount Q and the engine rotation speed Ne, and further sets a target fuel pressure of the fuel pump 2 based on the engine rotation speed Ne and the basic fuel injection pulse width Tp. Then, a control duty signal feedback corrected by a PID control and the like is output a pump drive circuit (FPCM) 13 to control the fuel pump 2, so that a basic duty set based on the engine rotation speed Ne and the basic fuel injection pulse width Tp, is feedback controlled based on the fuel pressure detected by the fuel pressure sensor 7 and the target fuel pressure, to obtain the target fuel pressure.

A pulse width Ti obtained by correcting the basic fuel injection pulse width Tp by using various correction coefficients COEF, etc. such as of the cooling water temperature Tw, etc., is corrected according to the fuel pressure to set a final pulse width Ti'. If described in detail, the fuel pressure sensor 7 detects the atmospheric pressure as a reference, and the intake air pressure sensor 9 detects the intake air pressure as an absolute pressure. Therefore, a value obtained by subtracting the intake air pressure from the atmospheric air pressure detected during the engine operation is stopped, is added to the detected fuel pressure to thereby calculate the fuel pressure with the intake air pressure as a reference, and the fuel injection pulse width is corrected based on the fuel pressure with the intake air pressure as a reference.

In the fuel pressure control device wherein the fuel pressure during the engine is in operation is feedback controlled as described above, the fuel pressure control (adjustment) according to the present invention is executed after the engine operation has been stopped.

Figure 2:
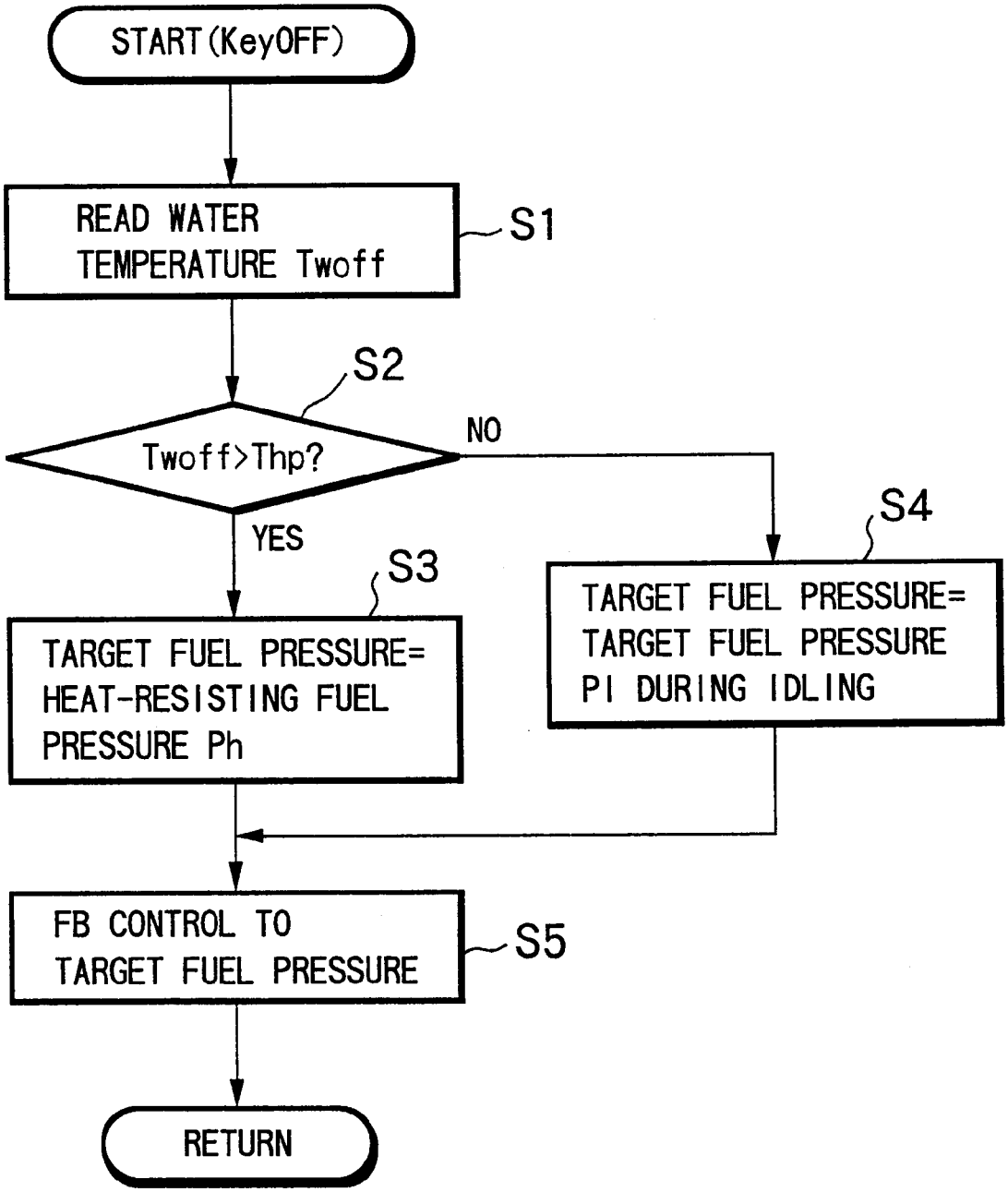
FIG. 2 is a flowchart of a fuel pressure adjusting routine when the engine is not in operation according to the first embodiment.

The adjustment of the fuel pressure of during the engine operation is stopped will now be described with reference to a flowchart of FIG. 2.

This flow is executed when the engine key switch is turned off.

At step 1, the water temperature Twoff at the time of key off detected by the water temperature sensor 12 is read as the engine environmental temperature of during the engine operation is stopped.

At step 2, the water temperature Twoff is compared with a heat-resisting determination temperature Thp.

When the water temperature Twoff exceeds the heat-resisting determination temperature Thp, the routine proceeds to step 3 where a target fuel pressure is set to a heat-resisting fuel pressure Ph set to be higher so as to meet the heat-resisting condition.

When the water temperature Twoff is equal to or lower than the heat-resisting determination temperature Thp, on the other hand, the routine proceeds to step 4 where the target fuel pressure is set to a target fuel pressure PI of during the idling operation.

Then, the routine proceeds to step 5 where the fuel pressure is feedback controlled to become the target fuel pressure based on the fuel pressure detected by the fuel pressure sensor 7. The control unit 8 and the power source of the fuel pump 2 are controlled by a self-shut-off control so as to be turned off after remaining turned on for a predetermined period of time after the engine operation is stopped, and the fuel pressure is adjusted during this period (since no fuel is injected after the engine operation is stopped, the fuel pressure quickly reaches the target fuel pressure, and the duty becomes 0 by the feedback control and, at this moment, the drive of the fuel pump 2 is substantially stopped).

Figure 3:
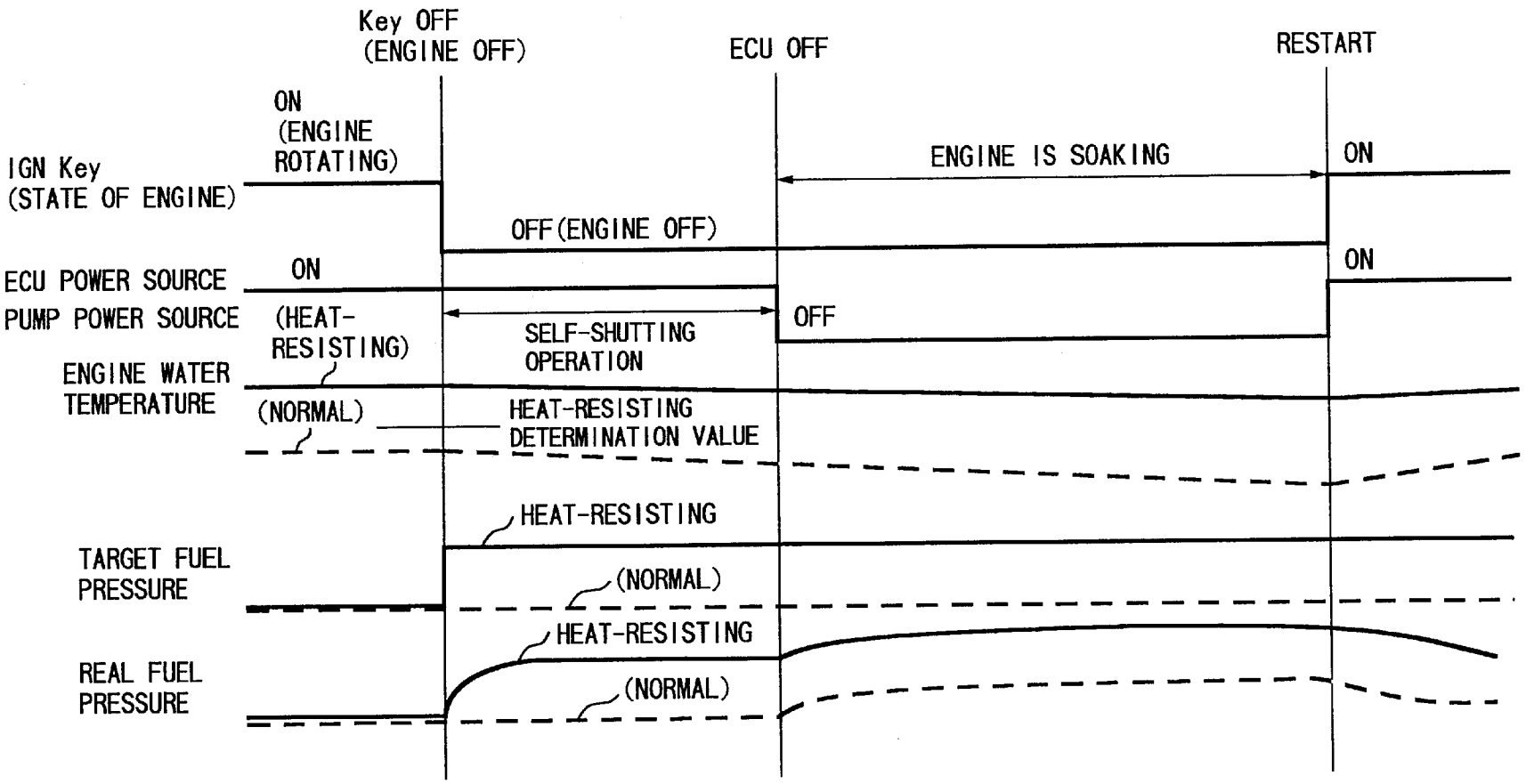
FIG. 3 is a time chart illustrating a change in the fuel pressure from the stop of the engine operation through up to the restart thereof in the first embodiment.

FIG. 3 illustrates a change in the fuel pressure from the engine operation stop through up to the restart in the first embodiment.

In a heat-resisting condition where the water temperature Twoff exceeds the heat-resisting determination temperature Thp, the fuel pressure confined in the fuel supply passage 3 downstream of the check valve 5 is adjusted to become the heat-resisting fuel pressure Ph, preventing the generation of vapor due to fuel vaporization, and ensuring a favorable restartability.

In a normal condition where the water temperature Twoff is equal to or lower than the heat-resisting determination temperature Thp, the fuel pressure confined in the fuel supply passage 3 downstream of the check valve 5 is maintained at the target fuel pressure Pl of during the idling operation. Here, as described above, conventionally, the target fuel pressure Pl during the idling operation had been set to be slightly higher by taking into consideration the restartability under the heat-resisting condition after the engine operation stop. According to the present invention, however, the fuel pressure is adjusted to be high under the heat-resisting condition. Therefore, the target fuel pressure Pl of during the idling operation may be set by taking the operation condition only into consideration without the need of considering the heat-resisting condition when the engine operation is stopped. Under the above normal condition, therefore, the fuel pressure is maintained at a low target fuel pressure Pl of during the idling operation, restraining the air-fuel ratio from becoming too rich due to a leakage from the fuel injection valve 4 at the time of restart to ensure favorable restartability.

Since the target fuel pressure of during the idling operation can be lowered, a difference in the fuel pressure relative to the peripheral operation regions is eliminated. Further, the performance deterioration due to a delay in the response in the fuel pressure feedback control can be prevented, and the electric power for driving the fuel pump 2 can be reduced to thereby improve the fuel economy.

Figure 4:
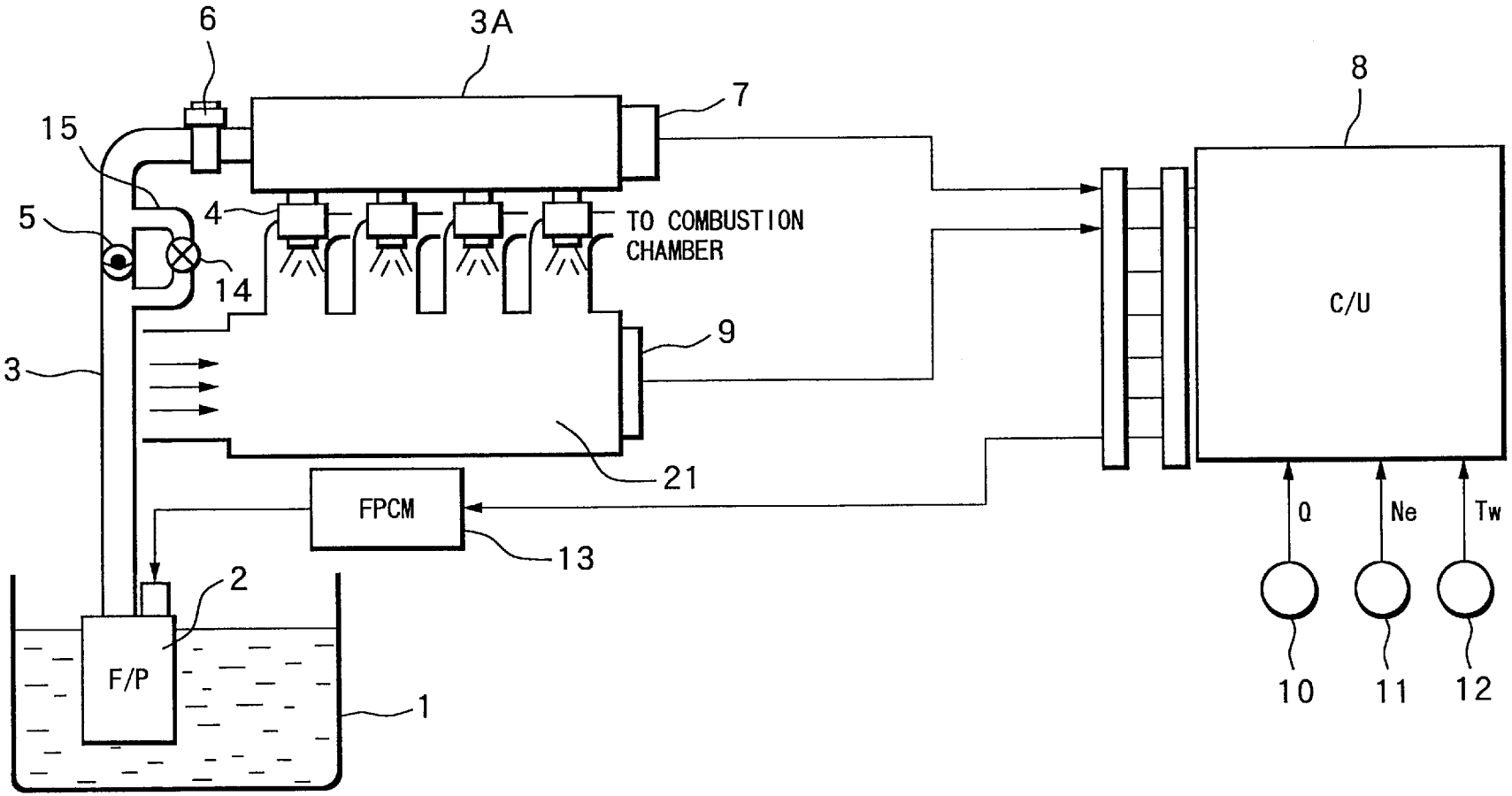
FIG. 4 is a diagram illustrating a system constitution of a second embodiment according to the present invention.

Next, described below is a second embodiment. In the second embodiment as shown in a system constitution of FIG. 4, a by-pass 15 provided with a relief valve 14 is connected to the fuel supply passage 3 by-passing the check valve 5 in addition to the constitution of the first embodiment. The relief valve 14 is of the electromagnetically driven type. The relief valve 14 is normally turned off and maintained to be closed.

Figure 5:
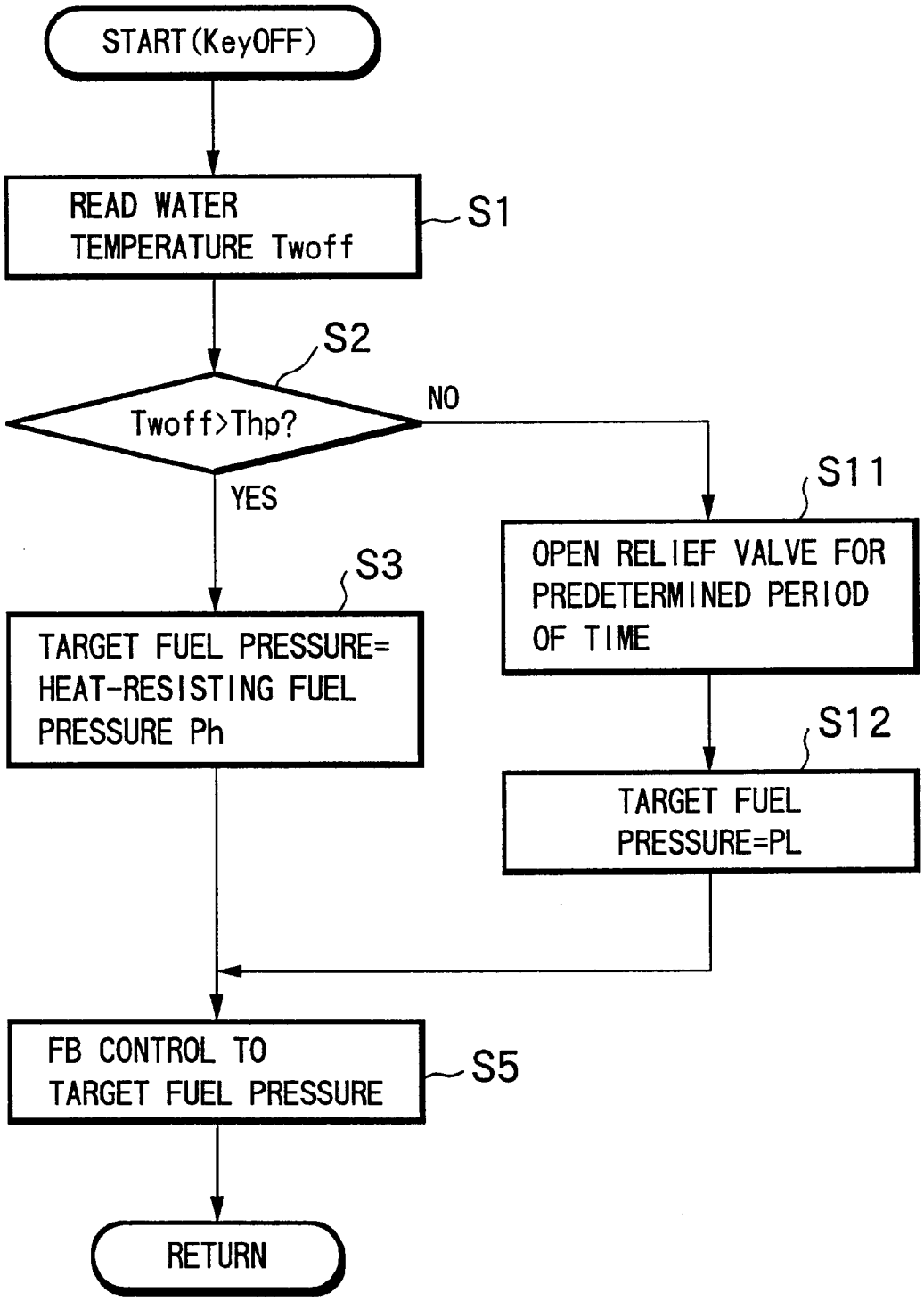
FIG. 5 is a flowchart of a fuel pressure adjusting routine when the engine is not in operation according to the second embodiment.

A routine for adjusting the fuel pressure of during the engine operation is stopped according to the second embodiment will now be described with reference to a flowchart of FIG. 5. Steps 1 to 3 and 5 are as described with reference to FIG. 2. Under the heat-resisting condition, the fuel pressure is controlled to become a heat-resisting fuel pressure Ph.

In the normal condition where the water temperature Twoff is equal to or lower than the heat-resisting determination temperature Thp, on the other hand, at step 11, the relief valve is turned on for a predetermined period of time and is opened to once return the fuel in the fuel supply passage 3 on the upstream side into the fuel tank 2 through the by-path 15, so that the fuel pressure in the fuel supply passage 3 is lowered down to 0 (atmospheric pressure). The fuel needs not be returned in all amounts but may be returned in some amounts.

Then, at step 12, after the target fuel pressure is set to a target fuel pressure PL lower than the target fuel pressure Pl of during the idling operation, at step 5, the fuel pressure is feedback controlled to become the target fuel pressure PL.

That is, for a while (during the soaking) after the engine operation has been stopped, there is no cooling air compared to during the engine operation, and the temperature in the engine room rises. Therefore, even if the fuel pressure is controlled to become the target fuel pressure of during the idling operation as in the first embodiment, the fuel pressure increases to be equal to or higher than the target fuel pressure of during the idling operation, it is difficult to completely prevent the leakage from the fuel injection valve 4. In this embodiment, therefore, the fuel pressure is set to a target fuel pressure lower than the target fuel pressure of during the idling operation by taking into consideration an increase in the fuel pressure during the soaking, to thereby more reliably prevent the leakage of fuel from the fuel injection valve 4.

After the engine operation has been stopped, no fuel is injected and, hence, the fuel pressure cannot be lowered by controlling the fuel pump 2. Therefore, after the fuel in the fuel supply passage 3 is once returned into the fuel pump 2 to lower the fuel pressure, the fuel pressure is raised up to the target fuel pressure.

Figure 6:
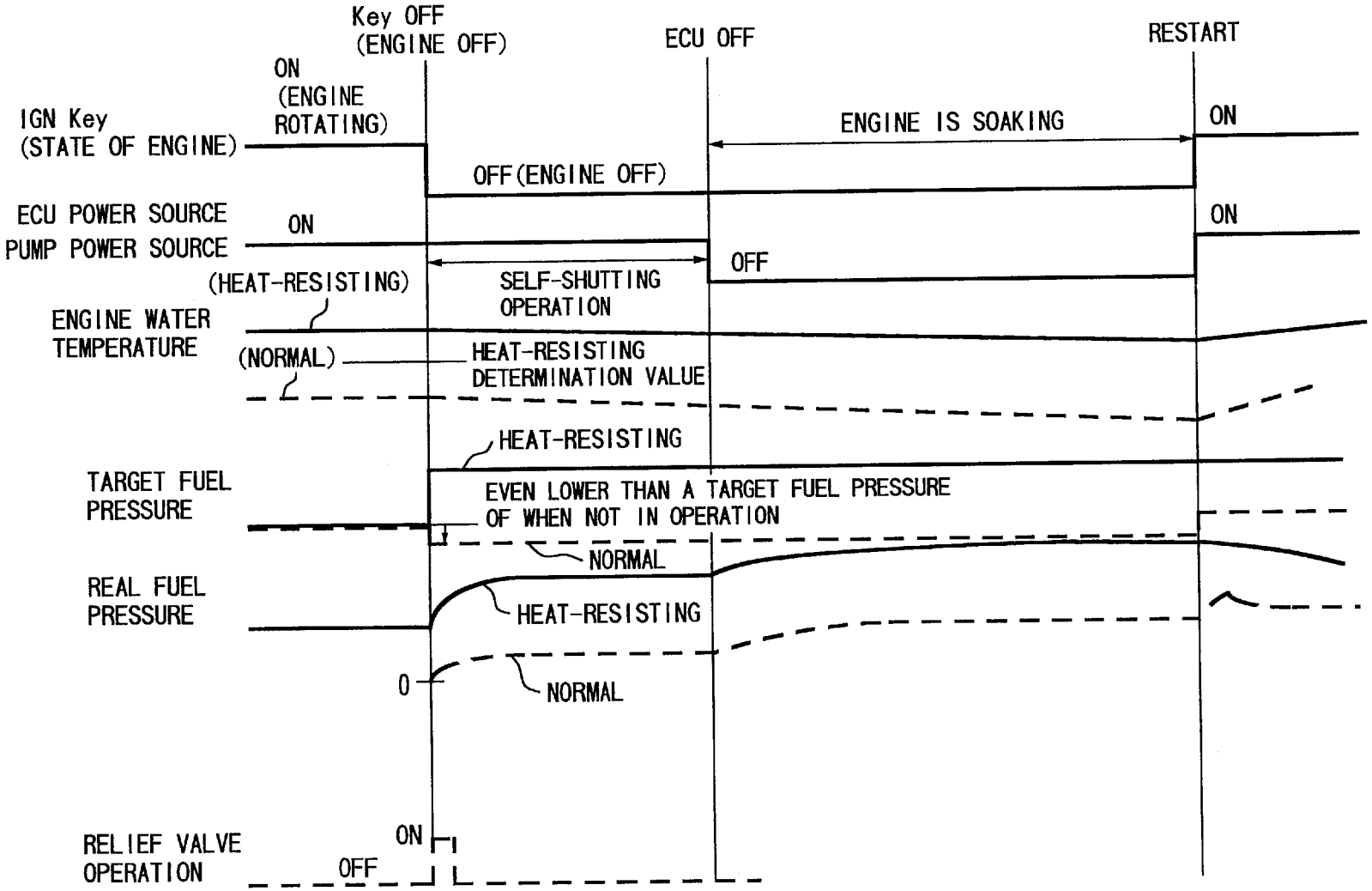
FIG. 6 is a time chart illustrating a change in the fuel pressure from the stop of the engine operation through up to the restart thereof in the second embodiment.

FIG. 6 illustrates a change in the fuel pressure from the engine operation stop through up to the restart in the second embodiment.

According to the above-mentioned embodiment, since the detection value of the water temperature sensor essential for controlling the engine is used for estimating the engine environmental temperature condition for determining the heat-resisting condition, the constitution can be simplified and the driving up of the cost can be avoided. In addition to this, a highly accurate determination may be rendered in combination with the intake air temperature and the on/off data of an air conditioner switch. Further, the highest accuracy can be accomplished if the determination is rendered based on the fuel temperature by providing a sensor for detecting the fuel temperature.

The target fuel pressure under the heat-resisting condition and the target fuel pressure under the normal condition in the second embodiment, may be fixed values for the simplicity, but may be variably set to more suitable target fuel pressures based on the detected water temperature or the like. Further, according to the second embodiment, the constitution may be such that the fuel pressure is controlled to a target fuel pressure set based on the water temperature and the like, after the fuel pressure is once lowered by unconditionally opening the relief valve without determining the heat-resisting condition after the engine operation stop.

The preferred embodiments of the present invention has been described, however, it will be apparent to those of ordinary skill in the art that various changes and modifications may be made without deviating from the inventive concepts set forth above.

The entire content of Japanese Patent Application No. 11-339319 filed on Nov. 30, 1999 is incorporated herein by reference.

What is claimed is:

1. A device for controlling the fuel pressure of an engine comprising:

fuel pressure detecting means for detecting the fuel pressure supplied from a fuel pump to a fuel injection valve through a fuel supply passage equipped with a check valve;

fuel pressure feedback control means for feedback controlling the drive of the fuel pump so that the fuel pressure in the fuel supply passage will become a target fuel pressure;

operation stop detecting means for detecting an engine operation stop;

engine environmental temperature detecting means for detecting an engine environmental temperature condition; and operation stop time fuel pressure adjusting means for adjusting the fuel pressure in the fuel supply passage, during the engine operation stop, to become a pressure that meets the engine environmental temperature condition during the engine operation stop, by said fuel pressure feedback control means.

2. A device for controlling the fuel pressure of an engine according to claim 1, wherein said operation stop time fuel pressure adjusting means adjusts the fuel pressure in the fuel supply passage, during the engine operation stop, to become a target fuel pressure during the idling operation when the engine environmental temperature during the engine operation stop is equal to or lower than a set temperature, and to become a heat-resisting target fuel pressure set to be higher than the fuel pressure during the operation of the engine when the engine environmental temperature during the engine operation stop exceeds the set temperature, by said fuel pressure feedback control means.

3. A device for controlling the fuel pressure of an engine according to claim 1, wherein said operation stop time fuel pressure adjusting means comprises a by-pass provided with a relief valve connected to the fuel supply passage by-passing said check valve, and adjusts the fuel pressure in the fuel supply passage, during the engine operation stop, to become a target pressure set to be lower than the fuel pressure during the operation of the engine after opening the relief valve to once drain the fuel in the fuel supply passage, when the engine environmental temperature during the engine operation stop is equal to or lower than a set temperature, and to become a heat-resisting target fuel pressure set to be higher than the fuel pressure during the operation of the engine, when the engine environmental temperature during the engine operation stop exceeds the set temperature, by said fuel pressure feedback control means.

4. A device for controlling the fuel pressure of an engine according to claim 1, wherein said engine environmental temperature detecting means detects an engine environmental temperature condition by a detection value of the engine cooling water temperature or by a value obtained by adding a detection value of the intake air temperature or an on/off detection value of an air conditioner to the detection value of the engine cooling water temperature.

5. A device for controlling the fuel pressure of an engine according to claim 1, wherein said engine environmental temperature detecting means detects an engine environmental temperature condition by a detection value of the fuel temperature.

6. A method of controlling the fuel pressure of an engine, comprising the steps of:

detecting a fuel pressure supplied from a fuel pump to a fuel injection valve through a fuel supply passage equipped with a check valve;

feedback controlling the drive of the fuel pump so that the fuel pressure in the fuel supply passage becomes a target fuel pressure;

detecting an engine operation stop;

detecting an engine environmental temperature condition when the engine operation stop is detected; and adjusting the fuel pressure in the fuel supply passage to meet the engine environmental temperature condition during the engine operation stop by feedback controlling the drive of the fuel pump.

7. A method of controlling the fuel pressure of an engine according to claim 6, wherein during said engine operation stop, the fuel pressure in the fuel supply passage is adjusted, by feedback controlling the fuel pressure, to become a target fuel pressure during the idling operation when the engine environmental temperature during the engine operation stop is equal to or lower than a set temperature, and to become a heat-resisting target fuel pressure set to be higher than the fuel pressure during the operation of the engine when the engine environmental temperature during the engine operation stop exceeds the set temperature.

8. A method of controlling the fuel pressure of an engine according to claim 6, wherein, during said engine operation stop, the fuel pressure in the fuel supply passage is adjusted, by feedback controlling the fuel pressure, to become a target pressure set to be lower than the fuel pressure during the operation of the engine after opening a relief valve connected to the fuel supply passage by-passing said check valve to once drain the fuel in the fuel supply passage, when the engine environmental temperature during the engine operation stop is equal to or lower than a set temperature, and to become a heat-resisting target fuel pressure set to be higher than the fuel pressure during the operation of the engine, when the engine environmental temperature during the engine operation stop exceeds the set temperature.

9. A method of controlling the fuel pressure of an engine according to claim 6, wherein the engine environmental temperature condition is detected by a detection value of the engine cooling water temperature or by a value obtained by adding a detection value of the intake air temperature or an on/off detection value of an air conditioner to the detection value of the engine cooling water temperature.

10. A method of controlling the fuel pressure of an engine according to claim 6, wherein the engine environmental temperature condition is detected by detecting the fuel temperature.

* * * * *